US010916387B2

(12) United States Patent
Dietz

(10) Patent No.: US 10,916,387 B2
(45) Date of Patent: Feb. 9, 2021

(54) MODULE COVER FOR A KEY MODULE FOR A KEY, KEY MODULE FOR A KEY, AND METHOD FOR PRODUCING A KEY

(71) Applicant: CHERRY GMBH, Auerbach/Opf (DE)

(72) Inventor: Tatjana Dietz, Nuremberg (DE)

(73) Assignee: CHERRY GMBH, Auerbach/Opf (DE)

( * ) Notice: Subject to any disclaimer, the term of this patent is extended or adjusted under 35 U.S.C. 154(b) by 0 days.

(21) Appl. No.: 16/496,350

(22) PCT Filed: Mar. 21, 2018

(86) PCT No.: PCT/EP2018/057170
§ 371 (c)(1),
(2) Date: Sep. 20, 2019

(87) PCT Pub. No.: WO2018/172411
PCT Pub. Date: Sep. 27, 2018

(65) Prior Publication Data

US 2020/0144003 A1 May 7, 2020

(30) Foreign Application Priority Data

Mar. 22, 2017 (DE) ..... 10 2017 106 162

(51) Int. Cl.
*H01H 13/02* (2006.01)
*F21V 3/06* (2018.01)
(Continued)

(52) U.S. Cl.
CPC ..... *H01H 13/023* (2013.01); *F21V 3/062* (2018.02); *H01H 11/00* (2013.01);
(Continued)

(58) Field of Classification Search
CPC ..... H01H 13/023; H01H 11/00; H01H 13/83; H01H 2219/036; H01H 2219/062;
(Continued)

(56) References Cited

U.S. PATENT DOCUMENTS 7,253,369 B2 * 8/2007 Fu ..... H01H 13/83 200/310
8,760,273 B2 * 6/2014 Casparian ..... H01H 13/702 340/407.2
(Continued)

FOREIGN PATENT DOCUMENTS

DE 102008042472 A1 * 4/2010 ..... H01H 13/023
EP 1467387 A1 * 10/2004 ..... H01H 9/182

OTHER PUBLICATIONS

International Search Report for International Application No. PCT/EP2018/057170, dated May 29, 2018, European Patent Office (Year: 2018).*

*Primary Examiner* — Rajarshi Chakraborty
*Assistant Examiner* — Glenn D Zimmerman
(74) *Attorney, Agent, or Firm* — James R. Hayne; Stites & Harbison PLLC

(57) ABSTRACT

A module cover comprising a through-hole for a passage of a key tappet of the key, a light injection region for injecting light from a light source into the module cover, a first light output region for outputting a first portion of the light, and a second light output region for outputting a second portion of the light out of the module cover. The first light output region and the second light output region, and a first light directing portion and a second light directing portion, are arranged on different sides of the through-hole. The first light directing portion directs a first portion of the light to the first light output region and a second portion of the light to the second light directing portion, and the second light directing portion directs at least part of the second portion of the light to the second light output region.

13 Claims, 2 Drawing Sheets

(51) Int. Cl.
*H01H 11/00* (2006.01)
*F21Y 115/10* (2016.01)
*H01H 13/83* (2006.01)

(52) U.S. Cl.
CPC ..... *F21Y 2115/10* (2016.08); *H01H 13/83* (2013.01); *H01H 2219/036* (2013.01); *H01H 2219/062* (2013.01); *H01H 2221/0702* (2013.01)

(58) Field of Classification Search
CPC ..... H01H 2221/0702; H01H 2221/056; H01H 2221/07; H01H 2223/038; F21V 3/062; F21Y 2115/10
See application file for complete search history.

(56) References Cited

U.S. PATENT DOCUMENTS

| | | | | |
|---|---|---|---|---|
| 8,870,477 | B2 * | 10/2014 | Merminod | H01H 11/00 400/490 |
| 2007/0235306 | A1 * | 10/2007 | Chiba | H01H 13/83 200/314 |
| 2009/0103964 | A1 | 4/2009 | Takagi et al. | |
| 2011/0193784 | A1 * | 8/2011 | Muller | G06F 3/0202 345/170 |
| 2014/0318939 | A1 | 10/2014 | Kimura et al. | |
| 2015/0061901 | A1 * | 3/2015 | Casparian | H01H 13/705 341/22 |
| 2016/0055988 | A1 * | 2/2016 | Muller | H01H 13/023 200/314 |

* cited by examiner

MODULE COVER FOR A KEY MODULE FOR A KEY, KEY MODULE FOR A KEY, AND METHOD FOR PRODUCING A KEY

The present invention relates to a module cover for a key module for a key, to a key module for a key, to a key, and to a method for manufacturing a key.

So as to be able to operate computer applications well also in dark rooms, for example, keyboards may comprise keycaps that may be backlit.

DE 10 2013 205 577 A1 discloses a key module for a key of a keyboard with a keycap that may be backlit.

Against this background, the present invention provides an improved module cover for a key module for a key, an improved key module for a key, an improved key, and an improved method for manufacturing a key according to the main claims. Advantageous embodiments are obvious from the dependent claims and in the subsequent description.

Advantageously, a module cover for a key module for a key may function both as a cover and as a light directing device or light guide. Thus, a functional combination of cover and light directing device or light guide can be realized in one component. The cover or module cover can be formed to guide light from a light source to a keycap over a large area. According to an embodiment, thereby homogeneous illumination the keycap is enabled.

A corresponding module cover for a key module for a key comprises:

a through-hole for a passage of a key tappet of the key;

a light injection region for injecting light from a light source into the module cover;

a first light output region for outputting a first portion of the light a second light output region for outputting a second portion of the light out of the module cover, wherein the first light output region and the second light output region are arranged on different sides of the through-hole; and a first light directing portion and a second light directing portion, which are arranged on different sides of the through-hole, wherein the first light directing portion is formed to direct a first portion of the light to the first light output region and a second portion of the light to the second light directing portion, and wherein the second light directing portion is formed to direct at least part of the second portion of the light to the second light output region.

The approach described can be employed in connection with a key module for a key. The key may comprise at least the key module, the light source and the at least partially translucent keycap. The key module may at least comprise the module cover, a module base coupleable to the module cover and the key tappet. In an assembled state of the key, at least the module cover of the key module may be arranged between the light source and the keycap, and the module cover may be arranged between the module base and the keycap. The key tappet may be accommodated partially in the key module so as to be movable relative to the module base and the module cover when the key is being actuated.

Advantageously, according to embodiments of the present invention, illumination of the keycap for a mechanical key or keyboard can be realized and enhanced without additional parts. This is also valid for the case that a light source is provided offset, laterally or decentrally placed with respect to a central vertical axis or actuation axis of the key. Complete or large-area, uniform and homogeneous in terms of color illumination of the keycap or at least translucent portions thereof can be enabled.

In contrast to an approach in which a transparent cover of a mechanical switch for keyboards with an integrated diffuser lens directs light from the light source, which is arranged below the lens, upward, light can be distributed in a large-area manner over the keycap, according to embodiments of the approach described here. This means that the keycap may be illuminated almost completely, wherein the light may be distributed not selectively but over the entire surface of the keycap. For example, colors of the light source may be mixed as homogeneously as possible. In contrast to the conventional approach of a pushbutton with a diffuser lens, particularly wherein the light source may be located below the diffuser lens, and the light may be directly output and diffused over the diffuser lens, the light is distributed in a large-area and uniform manner over the keycap, according to embodiments of the present invention. Thus, for example, it can be avoided that the light would be badly mixed in only one third of the keycap, for example, and primary colors of the light source would be individually visible partially. According to embodiments of the present invention, the primary colors may be mixed so that the light on the keycap appears homogeneous and white, for example.

The key may be part of a keyboard, such as a computer keyboard or the like. A keyboard may comprise at least one key, typically a plurality of keys. Using the module cover, background illumination of the key may be realized. When coupled to each other, the module base and the module cover of the key module may represent a basic body of the key module. In an assembled state of the key module, the key tappet may be accommodated so as to be movable along a longitudinal axis of extension of the key tappet at least partially within a basic body of the key module formed by the module base and the module cover. The key tappet may extend through the through-hole cover. Thus, the key tappet may comprise a portion variably protruding from the module cover depending on or actuation thereof. At a bottom portion, the key module may be attachable to a support element of a key or keyboard. In an assembled state of the key module, the module cover may be arranged between the module base and a keycap coupled to the key tappet. The keycap may represent a part of the key visible and operable by depressing. The keycap may be translucent at least in a symbol portion. The light source may be a light-emitting diode. The light source may be a variable-light light source. The variable-light source may preferably be RGB light-emitting diode or RGB LED or red-green-blue light-emitting diode. The light source may also be a surface-mounted device light source or SMD light source. The light source may be mounted or arranged on a circuit board or the like. The first light directing portion may be arranged optically between the light source and the second light directing portion. The first light directing portion may be formed to direct the first portion of the light to the first light output region in a first optical path and the second portion of the light to the first light output region in a second optical path within the module cover. The first light directing portion may be formed to at least partially reflect and additionally or alternatively transmit or output light from the light source. The first light directing portion may be formed to direct the second portion of the light directly or indirectly, for example via at least one further light directing portion, to the second light directing portion. The first and second light output regions may be arranged opposite or adjacent sides of the through-hole. Also, the first and second light directing portions may be arranged opposite or adjacent sides of the through-hole.

According to an embodiment, the first light directing portion may be formed on a first sidewall portion of the cover. The second light directing portion may be formed on a second sidewall portion of the module cover. The first sidewall portion and the second sidewall portion may be arranged on different sides of the through-hole, for example obliquely or directly opposite to each other. The module cover may comprise four sidewall portions if the module cover is formed to be prismatic, for example. Such an embodiment offers the advantage that comprehensive and large-area illumination of the keycap from at least two sides can be realized.

Here, the first light directing portion may comprise a plurality of light directing surfaces. Each light directing surface may have a plane of extension inclined relative to a wall plane of the first sidewall portion. The second light directing portion may have a plane of extension inclined relative to a wall plane of the second sidewall portion. Planes of extension of different light directing surfaces may be oriented identically and additionally or alternatively differently at least pairwise. Such an embodiment offers the advantage that division of the light from the light source into the first optical path and the second optical path can be achieved easily and reliably by means of the first light directing portion.

The first light directing portion may comprise at least one reflecting light directing surface. Such a light directing surface is suited to guide part of the light within the module cover as losslessly as possible. Furthermore, the first light directing portion may comprise a translucent light directing surface. Such a light directing surface is suitable as a light output region. According to an embodiment, at least one light directing surface is partially reflecting or partially transmissive. Such a light directing surface is suited to output part of the light from the module cover and forward another part of the light within the module cover.

Furthermore, the module cover may comprise at least one further light directing portion. The first light directing portion, the second light directing portion and the at least one further light directing portion may be arranged on different sides of the through-hole. In this case, the first light directing portion may be formed to direct the second portion of the light to the at least one further light directing portion. The at least one further light directing portion may be formed to direct at least part of the second portion of the light to the second light directing portion and additionally or alternatively to at least one further light output region of the module cover. The at least one further light directing portion may be arranged optically between the first light directing portion and the second light directing portion in a second optical path. Such an embodiment offers the advantage that the second portion of the light can be guided around the through-hole of the module cover more easily. Optionally, homogeneous and laminar illumination of the keycap from several sides can be made possible in addition.

Here, the at least one further light directing portion may comprise a first further light directing portion and a second further light directing portion. The first further light directing portion may be a third sidewall portion of the module cover. The second further light directing portion may be formed on a fourth sidewall portion of the module cover. The third sidewall portion and the fourth sidewall portion may be arranged opposite each other. Such an embodiment offers the advantage that light from the light source can be reliably redirected reflected from the first light directing portion to the second side directing portion on two separate optical paths within the module cover, in order to achieve uniform and large-area illumination of the keycap from two or four sides, for example. Thus, the second portion of the light may be guided around the recess of the module cover on two sides.

The module cover may be integrally formed. Additionally or alternatively, the module cover may be formed from transparent plastics material. Such an embodiment offers the advantage that a number of components of the key module can be kept small. Homogeneous illumination of the keycap can be improved further. For example, the module cover may be produced as an integral injection-molded part.

Furthermore, a key module for a key is presented, wherein the key comprises at least the key module, a light source and a keycap translucent at least in sections, wherein the key module at least comprises:

an embodiment of the previously mentioned module cover;

a module base, wherein the module base and the module cover are coupleable or coupled to each other; and the key tappet, wherein the key tappet is partially accommodatable or accommodated in the key module so as to be movable relative to the module base and the module cover when the key is being actuated.

An embodiment of the previously mentioned module cover may be employed or used advantageously conjunction with the key module, in order to direct light of the key module from a light source to a coupleable keycap so as to enable illumination of the keycap.

According to an embodiment, the key tappet may be translucent for light from the light source. Here, the module base and additionally or alternatively the module cover may be translucent for light from the light source at least in a subsection leading to the key tappet. Such an embodiment offers the advantage that uniform and large-area illumination of the keycap can be achieved.

What is also presented is a key, wherein the key at least comprises:

an embodiment of the previously mentioned key module;

the light source; and the keycap translucent at least in sections, wherein the key module is arrangeable or arranged between the light source and the keycap.

An embodiment of the previously mentioned key module may be employed or used advantageously conjunction with the key, in order to allow for illumination of the keycap.

According to an embodiment, the light source may be arranged adjacent to the module base of the key module, on the key module or at least partially within the key module. The module base may comprise a light transmission portion for transmitting light from the light source to the module cover and additionally or alternatively a through-hole for accommodating the light source. Such an embodiment offers the advantage that space and installation space can be saved.

Furthermore, in a mounted state of the key, the light source and the first light directing portion of the module cover may be arranged along a straight line which may extend in parallel to a longitudinal axis of extension of the key tappet of the key module and may be spaced from the longitudinal axis of extension. In particular, a longitudinal axis of extension of the key tappet passing through a center of central region of the key module may be spaced from a mounting location of the light source. Also, with respect to a viewing direction of or axis of extension of the key tappet, a mounting area of the light source may be spaced from a mounting area of the key tappet. Such an embodiment offers the advantage that the key tappet does not impair illumination of the keycap, because the light source is arrangeable or arranged spaced from the key tappet.

Moreover, a method for manufacturing a key is presented, wherein the method comprises at least the steps of:

providing an embodiment of the previously mentioned module cover;

arranging the key module and the light source so that the module cover of the key module is adjacent to the light source; and coupling the keycap to the key tappet so that the module cover is arranged between the light source and the keycap.

An embodiment of the previously mentioned key can be manufactured advantageously by executing the method.

The invention shall be explained in greater detail on the basis of the appended drawings, in which.

In the following description of preferred embodiments of the present invention, the same or similar reference numerals shall be used for the similarly acting elements illustrated in the various figures, wherein repeated description of these elements shall be omitted.

Figure 1:
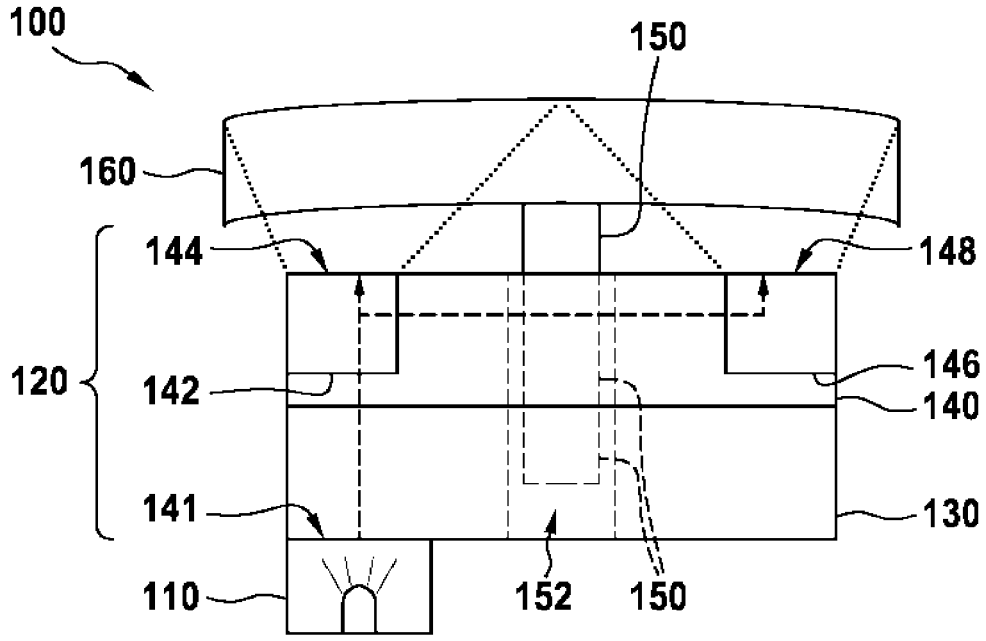
FIG. 1 shows a schematic illustration of a key according to an embodiment of the present invention.

FIG. 1 shows a schematic illustration of a key 100 according to an embodiment of the present invention. The key 100 may also be referred to as a mechanical pushbutton. For example, the key 100 is configured to be employed as a single key or in combination with at least one further key of a keyboard. A keyboard which may comprise the key 100, for example, is a computer keyboard.

According to the embodiment of the present invention illustrated in FIG. 1, the key 100 comprises a light source 110, a key module 120 and a keycap 160. The key module 120 here is arranged between the light source 110 and the keycap 160. The keycap 160 is designed or formed to be translucent at least in sections. The keycap 160 can be eliminated or backlit through the key module 120 and/or using the key module 120.

In the illustration of FIG. 1, a module base 130, a module cover 140 and a key tappet 150 are shown of the key module 120. The module base 130 and the module cover 140 are mechanically coupled to each other. The key tappet 150 is arranged to be movable relative to the module base 130 and the module cover 140 when the key 100 is being actuated. Here, the key tappet 150 is partially accommodated in the key module 120. In a non-actuated state of the key 100, a larger subsection of the key tappet 150 protrudes from the module cover then in an actuated state of the key 100.

The module cover 140 comprises a light injection region 141 via which light emitted from the light source 110 can be injected into the module cover 140. The module cover 140 comprises at least a first light directing portion 142 and a second light directing portion 146, for example. The first light directing portion 142 is formed to correct a first portion of the light injected via the light injection region 141 toward the keycap 160 via a first light output region 144 of the module cover 140 in a first optical path and a second portion of the injected light to the second light directing portion 146 in a second optical path. To this end, the first light directing portion 142 may comprise one or more light directing surfaces. The second light directing portion 146 is formed to direct at least part of the portion of the injected light received from the first light directing portion 146 toward the keycap 160 via a second light output region 148 of the module cover 140. To this end, the second light directing portion 146 may comprise one or more light directing surfaces. Thus, light from the light source 110 reaches the keycap 160 both via the first light directing portion 142 and the first light output region 144 and via the first light directing portion 142, the second light directing portion 146 and the second light output region 148. The module cover 146 may also comprise more than the two light output regions 144, 148 mentioned, which are arranged distributed over an upper side and optionally one or more side surfaces of the module cover 146, for example.

According to an embodiment, the module cover 140 is integrally formed. Additionally or alternatively, the module cover 140 is formed of transparent plastics material.

According to an embodiment, the light directing portions 142, 146 are formed by wall areas of an outer wall of the module cover 140. Each light directing portion 142, 146 may comprise one or more light directing surfaces. Different light directing surfaces of a light directing portion 142, 146 may have different inclinations with respect to each other. According to an embodiment, a light directing surface is formed as a planar surface. For example, light directing surface is triangular, quadrangular, polygonal, round or oval. According to an embodiment, a light directing surface is surrounded by a circumferential edge. According to an embodiment, a light directing surface is oriented at a suitable angle with respect to the propagation direction of light impinging on the light directing surface. Here, the angle is chosen so that the impinging light is redirected either to a further light directing surface of the same light directing portion 142 or to another light directing portion 146, or to a light output region 144, 148. According to an embodiment, an outside surface of a light directing surface represents a light output region 144, 148. In this case, the light directing surface is transmissible or at least partially transmissible for the light impinging on the light directing surface. Such a light directing surface shall also be referred to as guiding surface in the following. A light directing surface provided for redirecting the impinging light to a further light directing portion 146 is reflecting or at least partially reflecting. Such a light directing surface shall also be referred to as reflection surface in the following. According to an embodiment, such a light directing surface is formed to effect change of direction of between 45° and 145° of the impinging light beam. This way, a light beam the main component of which is oriented in parallel to a longitudinal axis of extension of the module cover 140 can be redirected so that the light beam is oriented transversal to the longitudinal axis of extension after the reflection, which means that the main component of the light beam is oriented transversal to the longitudinal axis of extension of the module cover 140 after the reflection, or vice versa.

The light injection region 141 and the light output regions 144, 148 are arranged on different sides of the module cover 140, according to one embodiment on opposite sides of the module cover 140. According to the embodiment shown, the light injection region 141 is formed on a lower side of the module cover 140, the light output regions 144, 148 are formed on an upper side thereof.

For example, the light source 110 may be a light-emitting diode, in particular an RGB light-emitting diode or RGB LED or red-yellow-blue light-emitting diode and/or a surface-mounted device light source or SMD light source. According to the embodiment of the present invention shown in FIG. 1, the light source 110 is arranged adjacent to the module base 130 of the key module 120 or on the key module 120. According to another embodiment, the light source 110 may be arranged at least partially within the key module 120, in particular the area of the module base 130. In a mounted state of the key 100, the light source 110 and the first light directing portion 142 of the module cover 140 are arranged along a straight line extending in parallel with a longitudinal axis of extension of the key tappet 150 of the key module 120 and spaced from the longitudinal axis of extension.

According to an embodiment, the key tappet 150 is translucent for light from the light source 110. Here, the module base 130 and/or the module cover 140 may be translucent for light from the light source 110 at least in a subsection leading to the key tappet 150.

Figure 2:
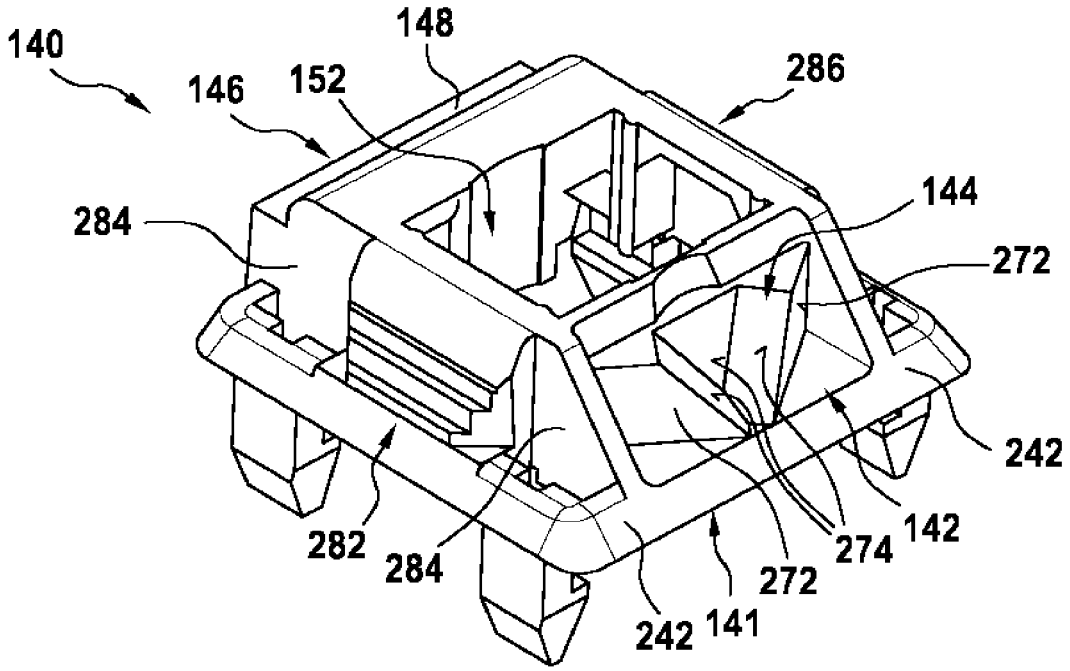
FIG. 2 shows a perspective illustration of a module cover according to an embodiment of the present invention.

FIG. 2 shows a perspective illustration of a module cover 140 according to an embodiment of the present invention. The module cover 140 corresponds to or is similar to the module cover from FIG. 1. In the illustration of FIG. 2, the first light directing portion 142, the second light directing portion 146, a first sidewall portion 242, a through-hole 152, a plurality of light directing surfaces 272, 274, a third light directing portion 282, a third sidewall portion 284 and a fourth light directing portion 286 are shown of the module cover 140. An outward shape, a contour or a silhouette of the module cover 140 here represents a cuboid-like shape and/or a frustum-of-pyramid-like shape.

The through-hole 152 is formed to accommodate a cross-sectional profile of the key tappet of the key module or permit passage of the key tappet of the key module. Here, the key tappet protrudes from the key module through the through-hole 152. The through-hole 152 the module cover 140 is arranged between the first light directing portion 142 and the second light directing portion 146 or between the first light output region and the second light output region. The second light directing portion 146 here is obstructed in the illustration and only shown implicitly in FIG. 2.

The first light directing portion 142 is formed on the first sidewall portion 242 of the module cover 140. The second light directing portion 146 is formed on a second side wall portion of the module cover 140 arranged facing away from the first sidewall portion 242 or opposite the first sidewall portion 242.

Furthermore, the module cover 140 merely exemplarily comprises the third light directing portion 282 and the fourth light directing portion 286 as further light directing portions, according to the embodiment illustrated here. The third light directing portion 282 is formed on the third sidewall portion 284 of the module cover 140. Furthermore, the fourth light directing portion 286 is formed on a fourth sidewall portion of the module cover arranged facing away from the third sidewall portion 284 or opposite the third sidewall portion 284. Due to the illustration, only the third light directing portion 282 is explicitly shown in FIG. 2.

According to the embodiment of the invention illustrated here, the third light directing portion 282 comprises a plurality of stepped parallel-translated light directing surfaces the planes of extension of which are aligned along a wall plane of the third sidewall portion 284. The stepped parallel-translated light directing surfaces form an appendage centrally arranged in the third sidewall portion 284 and protruding relative to the adjacent wall regions of the third sidewall portion 284, according to this embodiment.

Even though the fourth light directing portion 286 is obstructed in the illustration in FIG. 2 and shown only implicitly, the fourth light directing portion 286 is formed corresponding to the third light directing portion 282, according to an embodiment.

The first light directing portion 142 comprises the plurality of light directing surfaces 272, 274. Here, each of the light directing surfaces 272, 274 has a plane of extension inclined relative to a wall plane of the first sidewall portion 242. The first light directing portion 142 has a folded structure due to the differently inclined planes of extension of the plurality of light directing surfaces 272, 274. According to the embodiment illustrated here, all planes of extension of the plurality of light directing surfaces 272, 274 are inclined differently relative to the wall plane of the first sidewall portion 242.

According to the embodiment illustrated here, the plurality of light directing surfaces 272, 274 merely exemplarily comprise two first light directing surfaces 272 as reflection surfaces and three second light directing surfaces 274 as guiding surfaces. The first light directing surfaces 272 are formed to be quadrangular, for example. The first light directing surfaces 272 are formed to direct light from the light source to the second light directing portion 146 via the third light directing portion 282 and the fourth light directing portion 286. In that way, part of the light is guided around the recess 152 within the module cover 140. The second light directing surfaces 274 are arranged between the first light directing surfaces 272. For example, to quadrangular second light directing surfaces 274 are directly adjacent to the first light directing surfaces 272. The two quadrangular second light directing surfaces 274 also are directly adjacent to a triangular second light directing surface 274, which is arranged between the two quadrangular second light directing surfaces 274. The second light directing surfaces 234 are formed to direct light from the light source towards the keycap via the first light output region 144 of the module cover 140.

The third light directing portion 284 and the fourth light directing portion 284 are formed to direct light from the first light directing portion 142 to the second light directing portion 146. According to an embodiment, the third light directing portion 282 and the fourth light directing portion 284 may additionally or alternatively be formed to direct light from the first light directing portion 142 to at least one further light output region toward the keycap.

According to an embodiment, the light directing surfaces 272 and the light directing surfaces of the third light directing portion 282 and of the fourth light directing portion 286 are reflection surfaces, by which the light impinging on the respective light directing surfaces is reflected completely or at least for the most part and thereby remains within the material of the module cover 140. However, the light directing surfaces 274 are formed as guiding surfaces, by which the light impinging on the respective light guiding surfaces 274 is guided completely or at least for the most part out of the material of the module cover 140. According to this embodiment, the light guiding surfaces 274 function as the first light output region 144.

According to an embodiment, the light directing surface or the light directing surfaces of the second light directing portion 146 again are reflecting, in order to guide the impinging light to the separately formed second light output region 148.

Figure 3:
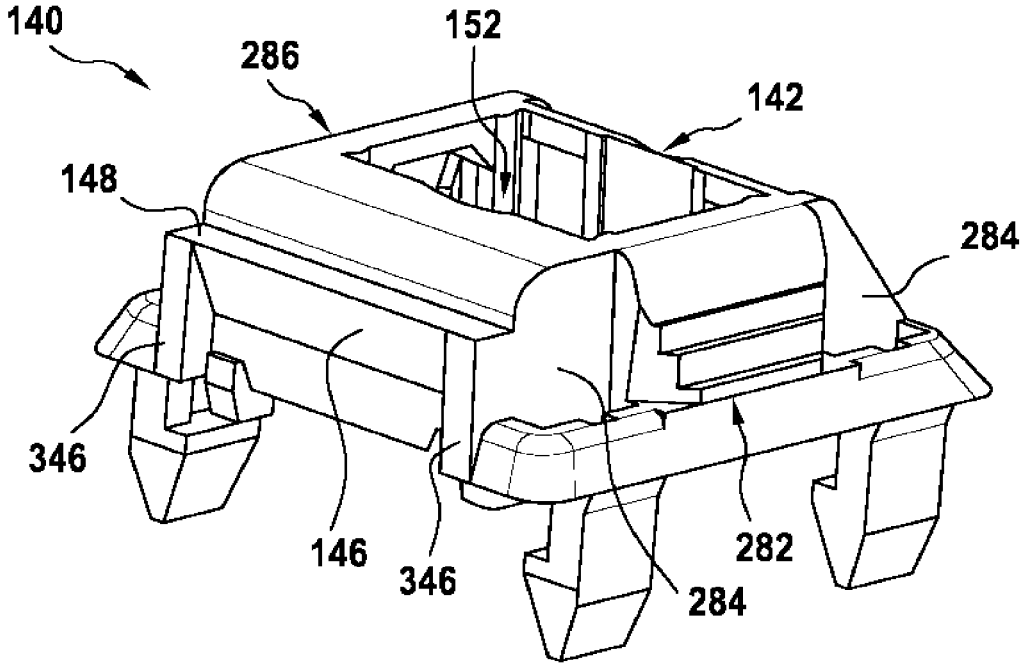
FIG. 3 shows a perspective illustration of a module cover according to an embodiment of the present invention.

FIG. 3 shows a perspective illustration of a module cover 140 according to an embodiment of the present invention. The module cover 140 corresponds to or is similar to the module cover from FIG. 1. According to an embodiment, it is another view of the module cover from FIG. 2. In the illustration of FIG. 3, the second light directing portion 146 and the second sidewall portion 346 are shown explicitly. The second light directing portion 146 has a plane of extension inclined relative to a wall plane of the second sidewall portion 346. For example, the second light directing portion 146 extends across at least two thirds of a length of the second sidewall portion 346.

With reference to the figures previously mentioned and described, embodiments and advantages of embodiments shall be again summarized and/or briefly presented in other words in the following.

According to an embodiment, the module cover 140 or light guide cover 140 is formed of transparent plastics and functions as cover and light guide in one. Starting from the light source 110, part of the light is projected in the direction of the keycap 160 by the second light directing surfaces 274 functioning as guiding surfaces, wherein another part of the light is guided around the module cover 140 via the further light directing portions 282 and 286 by the first light directing surfaces 272 functioning as reflection surfaces and projected in the direction of the keycap 160 on the second light directing portion 146 functioning as backward reflection surface. The first light directing portion 142 is formed configured to direct the light both in the direction of the keycap 160 and to the reflection surfaces of the other light directing portions 146, 182 and 186.

Thus, improved illumination of the keycap 160 can be achieved advantageously. Improved illumination improved distribution of the light over the entire keycap 160, laminar or large-area light distribution and improved mixing of RGB colors. Another advantage is that no additional components are needed. Hence, no additional costs for components occur and no additional assembly becomes necessary.

In the light guide cover 140, the light is guided from the side of the first light directing portion 142 to the side of the second light directing portion 146 and also output to the keycap 160 there by inclined light directing portions 142, 146, 182, 186 placed in a targeted way on the light guide cover 140. Thereby, the keycap 160 of such a key 100 can be illuminated completely or over a large area. Additionally, the primary colors red, yellow and blue are mixed homogeneously, for example, so that the light output to the keycap 160 appears white.

Figure 4:
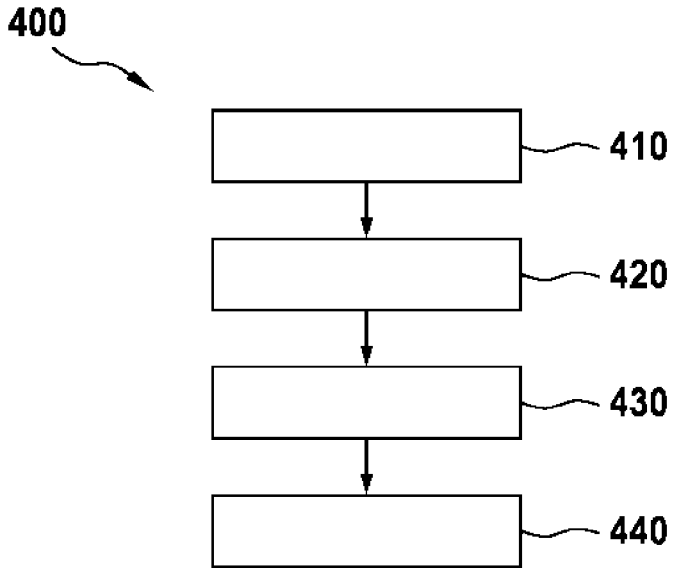
FIG. 4 shows a flowchart of a method for manufacturing according to an embodiment of the present invention.

FIG. 4 shows a flowchart of a method 400 for manufacturing a key according to an embodiment of the present invention. The key from FIG. 1 or a similar key can be manufactured by executing the method 400. The method 400 for manufacturing at least comprises a step 410 of providing, a step 420 of assembling a step 430 of arranging and a step 440 of coupling.

In the step 410 of providing, the module cover of one of the previously mentioned figures or a similar module cover is provided, for example in form of an integral injection molded part. Subsequently, in the step 420 of assembling, the key tappet, the module cover and the module base are assembled, in order to form the key module or couple the module cover with the module and accommodate the key tappet at least partially the key module so as to be movable relative to the module base and the module cover when the key is being actuated. In the step 430 of arranging, the key module and the light source are arranged with respect to each other so that the module cover of the key module is arranged between the light source and the already or subsequently coupled keycap. In the step 440 of coupling, the keycap is coupled to the key tappet or mechanically coupled with the key tappet.

The embodiments described and shown in the figures chosen merely as examples. Different embodiments may be combined with each other completely or with respect to individual features. An embodiment may also be supplemented by features of another embodiment. Steps of the method described may be executed repeatedly.

REFERENCE NUMERALS

100 key
110 light source
120 key module
130 module base
140 module cover
141 light injection region
142 first light directing portion
144 first light output region
146 second light directing portion
148 second light output region
150 key tappet
152 through-hole
160 keycap
242 first sidewall portion
272 first light directing surfaces
274 second light directing surfaces
282 third light directing portion
284 third sidewall portion
286 fourth light directing portion
346 second sidewall portion
400 method for manufacturing
410 step of providing
420 step of assembling
430 step of arranging
440 step of coupling

What is claimed is:

1. A module cover for a key module for a key, wherein the module cover comprises:

a through-hole for a passage of a key tappet of the key;

a light injection region for injecting light from a light source into the module cover;

a first light output region for outputting a first portion of the light a second light output region for outputting a second portion of the light out of the module cover, wherein the first light output region and the second light output region are arranged on different sides of the through-hole; and a first light directing portion and a second light directing portion, which are arranged on different sides of the through-hole, wherein the first light directing portion is formed to direct a first portion of the light to the first light output region and a second portion of the light to the second light directing portion, and wherein the second light directing portion is formed to direct at least part of the second portion of the light to the second light output region.

2. The module cover according to claim 1, wherein the first light directing portion is formed on a first sidewall portion of the module cover and the second light directing portion is formed on the second sidewall portion of the module cover, wherein the first sidewall portion and the second sidewall portion are arranged on different sides of the through-hole.

3. The module cover according to claim 1, wherein the first light directing portion comprises at least one reflecting light directing surface and at least one translucent light directing surface.

4. The module cover according to claim 1, comprising at least one further light directing portion, wherein the first light directing portion, the second light directing portion and the at least one further light directing portion are arranged on different sides of the through-hole, wherein the first light directing portion is formed to direct the second portion of the light to the at least one further light directing portion, and wherein the at least one further light directing portion is formed to direct at least part of the second portion of the light to the second light directing portion and/or to at least one further light output region of the module cover.

5. The module cover according to claim 1, which is integrally formed and/or formed of transparent plastics material.

6. A key module for a key, wherein the key comprises at least the key module, a light source and a keycap translucent at least in sections, characterized in that the key module at least comprises:

the module cover according to claim 1;

a module base, wherein the module base and the module cover are coupleable or coupled to each other; and the key tappet, wherein the key tappet is partially accommodatable or accommodated in the key module so as to be movable relative to the module base and the module cover when the key is being actuated.

7. A method for manufacturing a key, wherein the method at least comprises the steps of:

providing a module cover according to claim 1;

assembling a key tappet, the module cover and a module base to form a key module;

arranging the key module and the light source so that the module cover of the key module is adjacent to the light source; and coupling a keycap to the key tappet so that the module cover is arranged between the light source and the keycap.

8. The module cover according to claim 2, wherein the first light directing portion comprises a plurality of light directing surfaces, wherein each light directing surface has a plane of extension inclined relative to a wall plane of the first sidewall portion, and wherein the second light directing portion has a plane of extension inclined relative to a wall plane of the second sidewall portion.

9. The module cover according to claim 4, comprising a first further light directing portion and a second further light directing portion, wherein the first further light directing portion is formed on a third sidewall portion of the module cover and the second further light directing portion is formed on a fourth sidewall portion of the module cover, wherein the third sidewall portion and the fourth sidewall portion are arranged opposite to each other.

10. The key module according to claim 6, wherein the key tappet is translucent for light from the light source, wherein the module base and/or the module cover is or are translucent for light from the light source at least in a subsection leading to the key tappet.

11. A key, comprising:

the key module according to claim 6;

the light source; and the keycap translucent at least in sections, wherein the key module is arrangeable or arranged between the light source and the keycap.

12. The key according to claim 11, characterized in that in an assembled state of the key the light source and the first light directing portion of the module cover are arranged along a straight line extending in parallel with a longitudinal axis of extension of the key tappet of the key module and being spaced from the longitudinal axis of extension.

13. The key according to claim 11, wherein the light source is arranged adjacent to the module base of the key module, on the key module or at least partially inside the key module.

* * * * *